US008776746B2

(12) United States Patent
Scheidig et al.

(10) Patent No.: US 8,776,746 B2
(45) Date of Patent: Jul. 15, 2014

(54) INTEGRATION OF AN AXIAL BEARING IN A ROTOR

(71) Applicants: Gerhard Scheidig, Oberasbach (DE); Ali Bayrakdar, Rothenbach/Pegnitz (DE)

(72) Inventors: Gerhard Scheidig, Oberasbach (DE); Ali Bayrakdar, Rothenbach/Pegnitz (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/655,769

(22) Filed: Oct. 19, 2012

(65) Prior Publication Data

US 2013/0098321 A1 Apr. 25, 2013

(30) Foreign Application Priority Data

Oct. 21, 2011 (DE) ..... 10 2011 084 944

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01)
USPC ..... 123/90.17; 123/90.31

(58) Field of Classification Search
CPC . F01L 1/047; F01L 1/3442; F01L 2001/0476; F01L 2001/0475; F01L 1/143
USPC ..... 123/90.15, 90.17, 90.31, 90.6
See application file for complete search history.

(56) References Cited

U.S. PATENT DOCUMENTS 6,186,104 B1 * 2/2001 Torii et al. ..... 123/90.17
2007/0181086 A1 8/2007 Asbeck et al.

FOREIGN PATENT DOCUMENTS

DE 10346444 6/2005
DE 102004026863 8/2005
EP 1500793 1/2005

* cited by examiner

*Primary Examiner* — Zelalem Eshete
(74) *Attorney, Agent, or Firm* — Volpe and Koenig, P.C.

(57) ABSTRACT

A rotor (4) for a camshaft adjuster (14) is provided. The rotor (4) has a rotor core (6) that can be pushed onto a camshaft (2) and rotationally symmetric vanes (8) that extend radially away from the rotor core (6). Here, the rotor core (6) has an axial projection (10) projecting over the vanes (8). A profile (12) extends radially away from the axial projection (10).

10 Claims, 3 Drawing Sheets

INTEGRATION OF AN AXIAL BEARING IN A ROTOR

CROSS-REFERENCE TO RELATED APPLICATIONS

This application claims the benefit of German Patent Application No. 102011084944.0, filed Oct. 21, 2011, which is incorporated herein by reference as if fully set forth.

FIELD OF THE INVENTION

The invention relates to a rotor for a camshaft adjuster.

BACKGROUND

Camshaft adjusters are used in internal combustion engines, especially in four-stroke engines, for varying the control times of the valve timing. They comprise a rotor that is locked in rotation with the camshaft of the internal combustion engine and can be rotated, for example, hydraulically, forwards or backwards viewed in the direction of rotation of the camshaft relative to a stator.

Such a rotor is known from DE 10 2004 026 863 A1. The rotor has a rotor core with rotationally symmetric rotor vanes extending around this core. The rotor core further has an axial projection extending over the vanes.

SUMMARY

The objective of the invention is to improve the rotor.

This objective is met by a device including one or more features of the invention as discussed below.

The invention provides applying a radially extending profile on the axial projection of the rotor, in order to be able to support the rotor axially in a slot of a bearing block in a cylinder head.

The invention starts from the assumption that a camshaft must be secured against axial movements. For this purpose, for example, two securing elements can be used, such as collars, which are attached to a bearing block holding the camshaft in the front and back in the axial direction. In camshaft technology, the terms "forward" and "front" on the camshaft designate the direction toward the camshaft adjuster, while the terms "backward" and "back" on the camshaft designate the direction away from the camshaft adjuster.

The invention is based on the idea that the axial securing must be arranged as far forward as possible on the camshaft for technical and commercial reasons. Thus, a rear axial bearing of the camshaft deforms, for example, the magnetic stroke of the central valve when the camshaft is expanded due to thermal expansion or contracts due to thermal shrinkage.

An arrangement of the axial bearing of the camshaft as far forward as possible, that is, at the first bearing block, is usually difficult, however, because there is not sufficient space for two securing elements. If the rotor core of the rotor is made longer axially toward the back via a projection, this makes the problem of space even more difficult. In order to nevertheless provide an axial bearing of the camshaft as far forward as possible, the invention provides the axial projection on the rotor for the axial bearing on the front-most bearing block.

For this purpose, the invention discloses a rotor for a camshaft adjuster that comprises a rotor core that can be pushed onto a camshaft and rotationally symmetric vanes that extend radially from the rotor core. Here, the rotor core has an axial projection that extends over the vanes. According to the invention, a profile extends radially from the axial projection.

The radially extending profile can be used directly for the axial bearing of the rotor and thus of the camshaft by means of the camshaft adjuster. Thus, the radially extending profile can contact the forward-most, first bearing block or can be placed in a slot within this bearing block. Thus, in the most cost-effective way, an axial bearing of the rotor and thus of the camshaft is implemented by the camshaft adjuster, because at least one axial securing element can be eliminated on the camshaft. In addition, the axial bearing of the camshaft can also be realized on a smaller installation space due to the eliminated axial securing element, which represents a significant packaging advantage in some engines.

In one improvement of the invention, the radially extending profile is a component that is separate from the rotor. Therefore, conventional rotors of a camshaft adjuster can also be retrofitted in the way according to the invention.

In an additional improvement of the invention, the radially extending profile is a collar placed around the axial projection. A collar is understood to be a metal band that is placed around axially symmetric objects, such as rods, bars, or tubes. In the present construction, the collar is placed around the axial projection of the rotor, which is to be implemented in an especially simple way in terms of production. For fastening the collar on the axial projection, any method can be used, for example, welding, soldering, adhesion, or bolting.

The collar is connected to the rotor in an especially preferred way with an interference fit. This has the advantage that the collar can be fastened on the axial projection without additional bonding agents, such as welding or soldering material, adhesives, or bolts.

The invention also provides an axial bearing that comprises a bearing block with an axial slot directed in the radial direction toward the camshaft and a disclosed rotor. Here, the radially extending profile is placed in the slot. The radially extending profile is secured in the slot at the front and back in axial direction, so that the complete axial bearing of the rotor can be implemented with a single securing element. This further reduces the costs and the installation space of the axial bearing.

In one preferred improvement, the axial bearing comprises the camshaft over which the rotor is pushed.

In one especially preferred construction, the camshaft is supported in the rotor in the axial direction, so that an axial bearing of the camshaft opposite the bearing block is also simultaneously produced by the axial bearing of the rotor opposite the bearing block.

The invention also provides a cylinder head with this axial bearing.

The invention also provides an internal combustion engine with a disclosed cylinder head.

The invention also discloses a vehicle with a disclosed internal combustion engine.

BRIEF DESCRIPTION OF THE DRAWINGS

An embodiment of the invention will be explained in more detail with reference to the drawings in which.

DETAILED DESCRIPTION OF THE PREFERRED EMBODIMENTS

Figure 1:
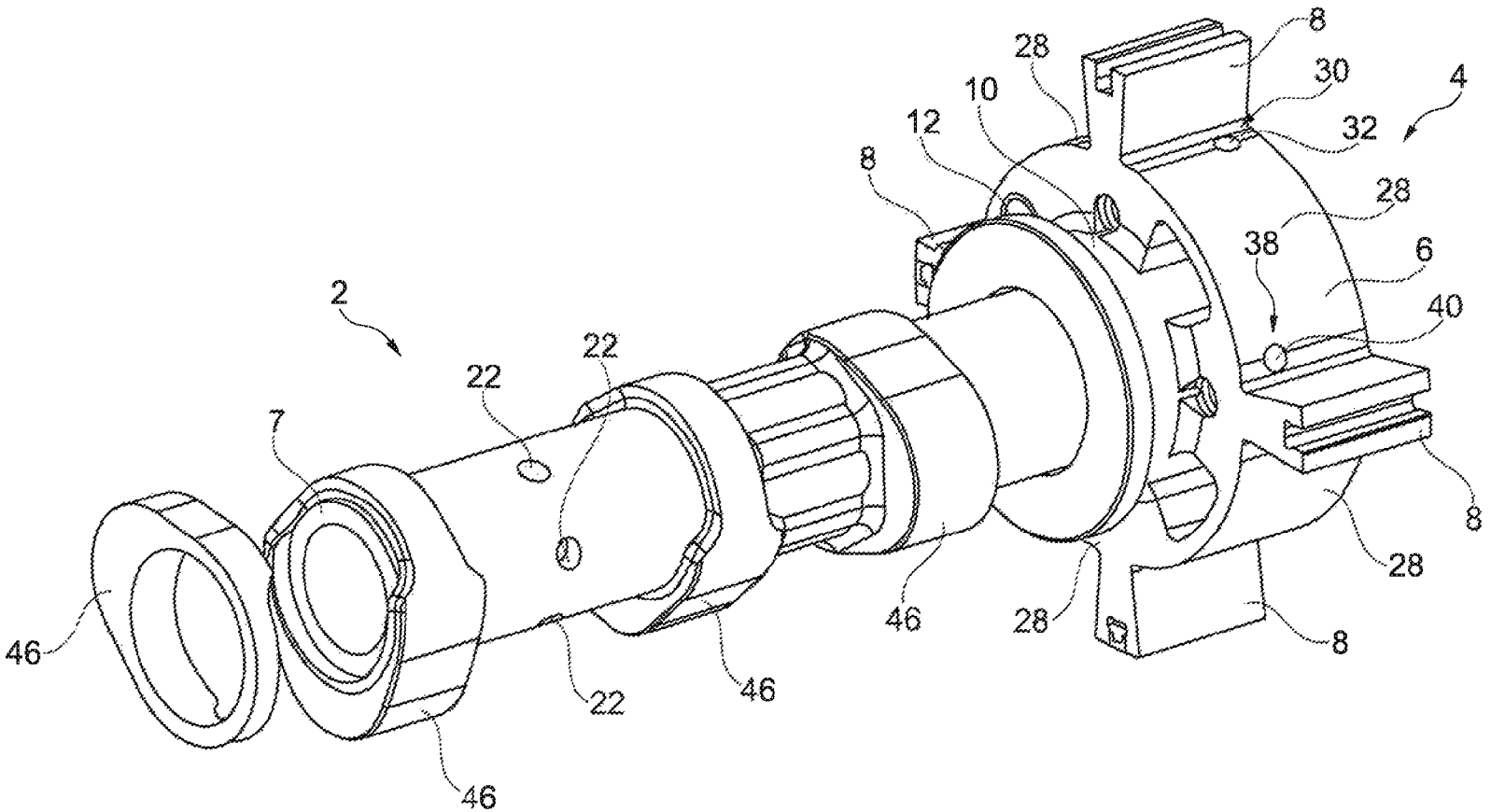
FIG. 1 is a perspective view of a rotor according to the invention set on a camshaft.
Figure 2:
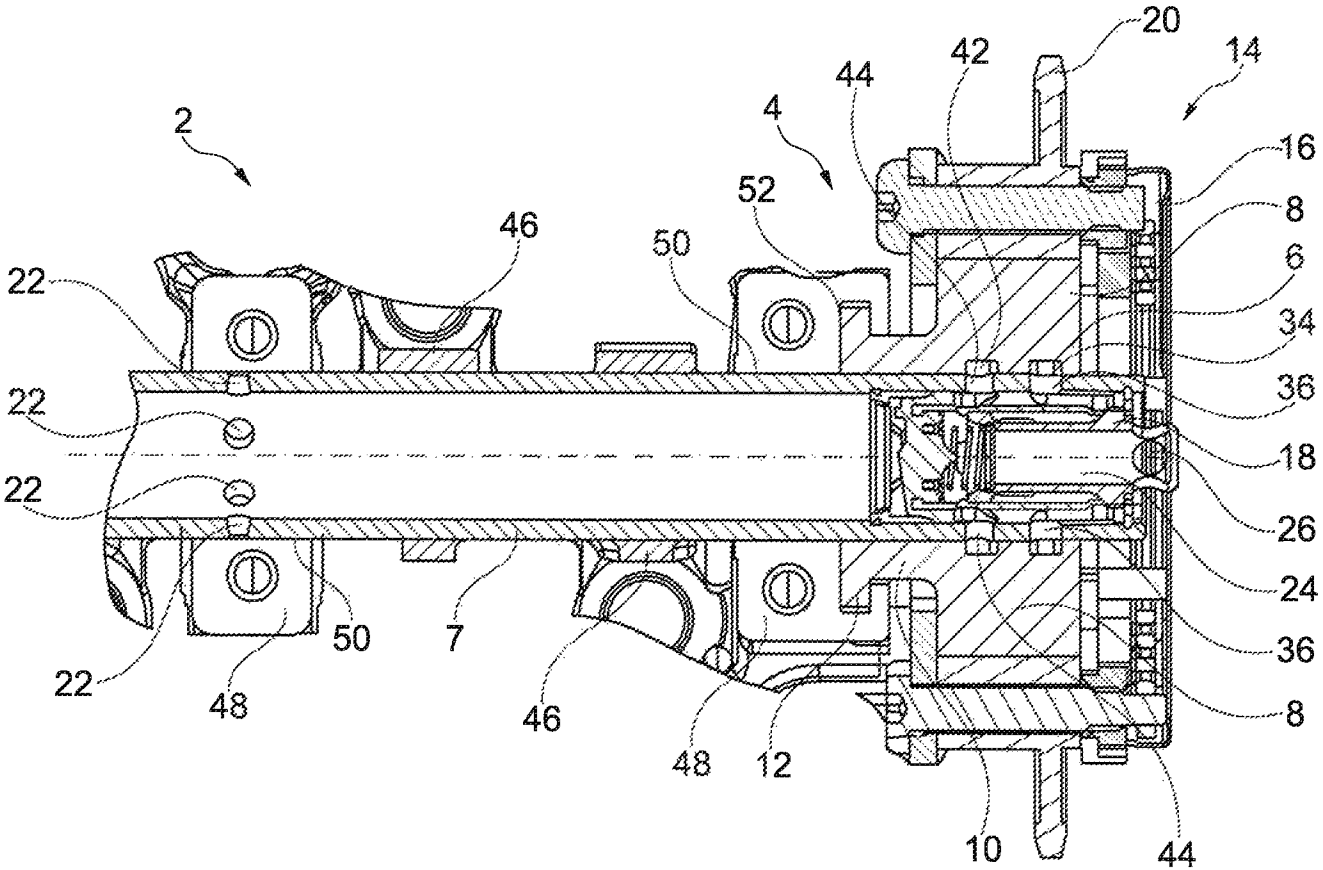
FIG. 2 is a sectional diagram of the rotor from FIG. 1.

Reference is made to FIGS. 1 and 2 that show a perspective view and a section view of a rotor 4 according to the invention set on a camshaft 2.

The rotor 4 comprises a tubular rotor core 6 that is pushed onto a tube body 7 of the camshaft 2 with an interference fit. Rotationally symmetric vanes 8 extend radially from the rotor core 6. An axial projection 10 further extends axially from the vanes 8. A profile 12 that has not yet been described extends from the axial projection 10 at an axial end of the axial projection 10 opposite the vanes 8.

The rotor 4 is part of a known camshaft adjuster 14 that is shown in FIG. 2. The camshaft adjuster 14 contains, in addition to the rotor 4, a stator 16 and a directional control valve 18. While the rotor 4 is locked in rotation with the tubular body 7 of the camshaft 2 by the interference fit, the stator 16 is locked in rotation with a gearwheel 20 by which the camshaft 2 receives its drive energy in a known way from a not-shown internal combustion engine. The directional control valve 18 can change a relative angular position between the rotor 4 and the stator 16 through the control of a not-shown hydraulic fluid flow.

The hydraulic fluid is guided out from oil supply boreholes representing a P connection 22 in the tubular body 7 via the interior of the tubular body 7 into the directional control valve 18 of the camshaft adjuster 14. The directional control valve 18 has a gate valve 24 with an oil outlet hole representing a T connection 26 and can be moved in the axial direction in the tubular body 7. The construction of the directional control valve 18 is known to the person skilled in the art and therefore shall not be explained in more detail for the sake of brevity.

The stator 16 is divided in the interior into not-shown chambers. The basis for these chambers are quarter-circle-shaped sections 28 that are constructed on the rotor core 6 by the vanes 8 and are divided into the chambers by not-shown partition walls on the stator 16. Thus, viewed in the plane of the drawing of FIG. 1, there is always a chamber in front of and behind a vane 8. The chamber in front of a vane 8 is connected by an A connection 30 to the directional control valve 18. The A connection 30 has a first supply borehole 32 through the rotor core 6, with this borehole opening into a first annular groove 34 on the inside of the rotor core 6 directed toward the tubular body 7. Via the first connection boreholes 36 through the tubular body 7, the first annular groove 34 is connected to the directional control valve 18. The chamber behind a vane 8 is connected by a B connection 38 to the directional control valve 18. The B connection 38 has a second supply borehole 40 that opens into a second annular groove 42 on the inside of the rotor core 6 directed toward the tubular body 7. The second annular groove 42 is connected to the directional control valve 18 by second connection boreholes 44 through the tubular body 7.

In a first axial position of the directional control valve 18 in the tubular body 7, the P connection 22 is connected to the A connection 30 and the T connection 26 is connected to the B connection 38. In a second axial position of the directional control valve 18 in the tubular body 7, wherein this position is different from the first axial position of the directional control valve 18, the P connection 22 is connected to the B connection 38 and the T connection 26 is connected to the A connection 30. In this way, hydraulic fluid can be pumped out from the P connection 22 into the chambers of the camshaft adjuster 14 and pressure can be built up between the vanes 8 and the partition walls, so that depending on whether hydraulic fluid is introduced into the A connection 30 or the B connection 38, the vanes of the rotor 4 are displaced in the rotational direction of the camshaft 2 or against the rotational direction of the camshaft 2 starting from the partition walls of the stator 16.

Cams 46 that are provided in a way that is known to someone skilled in the art for opening the valves of the internal combustion engine are arranged on the tubular body 7 of the camshaft 2.

The tubular body 7 of the camshaft 2 is held radially in the bearing blocks 48. For this purpose, each bearing block 48 has an axial passage 50. The passage 50 of the bearing block 48 in the next position in the axial direction on the camshaft adjuster 14 is extended radially on the side directed toward the camshaft adjuster 14. In the radially extended area of the passage 50, the axial projection 10 of the rotor 4 is introduced. An axial slot 52 in which the profile 12 of the axial projection 10 is held is constructed on the inside of the radially extended area.

Together with the profile 12 of the axial projection 10, the axial slot 52 forms a bearing that holds the rotor 4 in the axial direction. As already mentioned, the rotor 4 is connected to the tubular body 7 with an interference fit, so that the rotor 4 holds the tubular body 7 in the axial direction. Through the axial securing of the rotor 4 on the bearing block 48, the tubular body 7 is thus secured and in this way also the camshaft 2 is secured in the axial direction on the bearing block 48. Additional measures for the axial bearing of the camshaft 2 are thus not required.

The profile 12 is constructed in the present construction integrally with the axial projection 10. Alternatively, a separate collar could also be formed that can be attached rigidly in the axial direction on the axial projection 10 by, for example, an interference fit, welding, soldering, adhesion, bolting, wedging, or in some other way.

Figure 3:
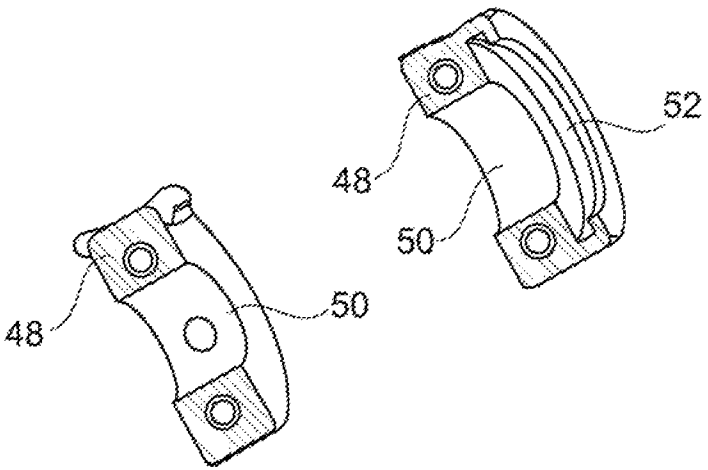
FIG. 3 is a perspective view of a part of a cylinder head in which the rotor according to the invention can be used.

In FIG. 3, parts of the bearing blocks 48 are shown in a perspective view.

As can be seen from FIG. 3, the bearing blocks 48 have the passages 50 for the radial holding of the tubular body 7 of the camshaft 2. Here, the slot 52 for holding the profile 12 is constructed in one of the bearing blocks 48.

LIST OF REFERENCE NUMBERS

2 Camshaft
4 Rotor
6 Rotor core
7 Tubular body
8 Vane
10 Projection
12 Profile
14 Camshaft adjuster
16 Stator
18 Directional control valve
20 Gearwheel
22 P connection
24 Gate valve
26 T connection
28 Section
30 A connection
32 Borehole
34 Groove
36 Borehole
38 B connection
40 Borehole
42 Groove
44 Borehole
46 Cam
48 Bearing block

50 Passage

52 Slot

The invention claimed is:

1. A rotor for a camshaft adjuster, comprising a rotor core that is adapted to be pushed onto a camshaft and rotationally symmetric vanes that extend radially away from the rotor core, the rotor core has an axial projection projecting past the vanes, and a profile extends radially away from the axial projection and is adapted to be received in a U-shaped axial groove formed in a camshaft bearing block to axially position the camshaft with the camshaft bearing block.

2. The rotor according to claim 1, wherein the radially extending profile is a component that is separate from the rotor.

3. The rotor according to claim 1, wherein the radially extending profile is a collar placed around the axial projection.

4. The rotor according to claim 3, wherein the collar is connected to the rotor with an interference fit.

5. An axial bearing comprising the camshaft bearing block and a rotor according to claim 1, wherein the radially extending profile is located in the groove in the bearing block.

6. An axial bearing according to claim 5, comprising a camshaft over which the rotor is pushed.

7. An axial bearing according to claim 6, wherein the camshaft is supported axially in the rotor.

8. A cylinder head comprising an axial bearing according to claim 5.

9. An internal combustion engine comprising a cylinder head according to claim 8.

10. A vehicle comprising an internal combustion engine according to claim 9.

* * * * *